United States Patent [19]

Mays et al.

[11] 4,438,775

[45] Mar. 27, 1984

[54] APPARATUS AND PROCESS FOR TREATING TOBACCO

[75] Inventors: Charles D. Mays, Lewisville; Max A. Wagoner; Daniel G. Williard, both of Winston-Salem, all of N.C.

[73] Assignee: R. J. Reynolds Tobacco Company, Winston-Salem, N.C.

[21] Appl. No.: 269,289

[22] Filed: Jun. 2, 1981

[51] Int. Cl.[3] ..... A24B 3/18

[52] U.S. Cl. ..... 131/300; 131/302; 131/304

[58] Field of Search ..... 131/300, 302, 303, 304, 131/305, 306, 220

[56] References Cited

U.S. PATENT DOCUMENTS

| | | | |
|---|---|---|---|
| 3,016,906 | 1/1962 | Peters | 131/108 |
| 3,419,015 | 12/1968 | Wochnowski | 131/138 |
| 3,624,748 | 11/1971 | Strydom | 131/110 |
| 3,742,961 | 7/1973 | Waller | 131/138 |
| 4,054,145 | 10/1977 | Berndt et al. | 131/138 |
| 4,102,349 | 7/1978 | Psaras et al. | 131/303 |
| 4,148,325 | 4/1979 | Solomon et al. | 131/134 |

*Primary Examiner*—V. Millin

*Attorney, Agent, or Firm*—Herbert J. Bluhm

[57] ABSTRACT

A continuous process and apparatus for applying treating fluids to tobacco involves a vertically disposed tower or chamber that is provided with tobacco inlet and outlet means, a plurality of cooperating, vertically spaced baffles arranged in alternating fashion and a plurality of spraying devices located within the tower or chamber at points intermediate the inlet and outlet means. Tobacco and treating fluid are introduced into the tower or chamber at controlled flow rates via the tobacco inlet means and spraying devices, respectively, to give tobacco treated with the desired quantities of treating fluid.

14 Claims, 4 Drawing Figures

APPARATUS AND PROCESS FOR TREATING TOBACCO

TECHNICAL FIELD

This invention relates to the processing of tobacco for use in the manufacture of tobacco products and more particularly to the continuous application of treating fluids to tobacco.

BACKGROUND ART

In the manufacture of tobacco products it is common practice to apply to the tobacco certain additives such as casing materials and top flavorings. Casing is usually applied to leaf strips or threshed leaf prior to cutting and generally includes humectants such as glycerol, diethylene glycol and propylene glycol along with flavoring materials such as sugar, cocoa and licorice. Top flavorings are generally applied to cut tobacco as a dilute solution in a volatile solvent such as ethanol. In either case it is important that these additives be applied to the tobacco as uniformly as possible at the desired use levels. Considerable attention has, therefore, been given to methods and apparatus for applying these additives to tobacco.

Apparatus that is used in the art for applying additives to tobacco includes a rotary drum provided with one or more spray nozzles through which the additives are applied to the tobacco as it tumbles on the inside surface of the rotating drum. Such apparatus is described, for example, in U.S. Pat. Nos. 3,419,015 and 4,054,145. A pneumatic system for applying a menthol solution to tobacco is disclosed in U.S. Pat. Nos. 3,548,838 and 3,678,939. An improved pneumatic system which avoids the use of solvents for applying menthol to tobacco is the subject of U.S. Pat. No. 3,800,806. Apparatus disclosed in U.S. Pat. No. 3,742,961 is directed primarily to stream treatment of tobacco but teaches incidentally the application of flavorants and other additives to the tobacco in conjunction with the steaming operation.

Although the inventions referred to in the foregoing patents are effective to a degree, certain disadvantages associated with one or more of these prior art devices are the high initial cost of equipment, high operational and maintenance costs, non-uniform or insufficient application of additives to the tobacco being treated, potential explosion hazards associated with volatile solvents used as a carrier for the additives and difficulty in confining volatile additives and-or solvents within the tobacco treating system.

DISCLOSURE OF INVENTION

The present invention provides a compact and effective apparatus for applying uniform quantities of additives to tobacco in a continuous operation. The apparatus comprises a vertically disposed tower having side walls and provided with inlet means in the upper portion of the tower for introducing a stream of cut or shredded tobacco into the tower and outlet means in the lower portion of the tower through which treated tobacco is discharged. Positioned within the tower intermediate the inlet and outlet means are a plurality of cooperating, vertically spaced baffles arranged in alternating, opposed fashion. The stream of tobacco which is introduced into the tower via the inlet means falls under the influence of gravity to the outlet means below with the downward flow of the tobacco being momentarily deflected by the baffles. The tower is also provided with a plurality of spraying devices located within the tower at points intermediate the inlet and outlet means for applying to the falling tobacco a treating fluid containing the desired additives. Deflection of the falling tobacco stream by the baffles provides sufficient agitation and mixing of the tobacco particles to permit more uniform application of the additives to the tobacco. The actual quantities of additives applied are established by carefully controlling tobacco and treating fluid flow rates.

An important advantage of the presently disclosed apparatus is that additives can be applied to tobacco without the use of volatile carriers such as ehtanol. Menthol, for example, can be applied as a top flavoring to cut or shredded tobacco using one or more humectants as the carrier. Humectants which are suitable in this regard include polyhydric alcohols such as glycerol, $\alpha$-methylglycerol, propylene glycol, dipropylene glycol, trimethylene glycol, diethylene glycol, triethylene glycol and 1,2-, 1,3-, 1,4- and 2,3-butanediols. Since such humectants are usually included in casing formulations applied to tobacco strips, it is preferred that at least a portion of the humectant normally included in the casing materials be withheld therefrom for use as a vehicle or carrier for the menthol applied as a top flavoring. Thus, the net result is that the tobacco is treated with substantially the same total quantities of humectant and menthol while realizing considerable economic benefits associated with the elimination of the volatile carrier for menthol that has been traditionally used. An added advantage is that the high boiling points of the humectants tend to reduce menthol losses to the atmosphere during application of the menthol/humectant treating fluid.

The exact manner in which tobacco is treated with additives in accordance with this invention is more clearly shown by referring to the drawings and the following detailed description of the drawings.

DESCRIPTION OF PREFERRED EMBODIMENTS

Figure 1:
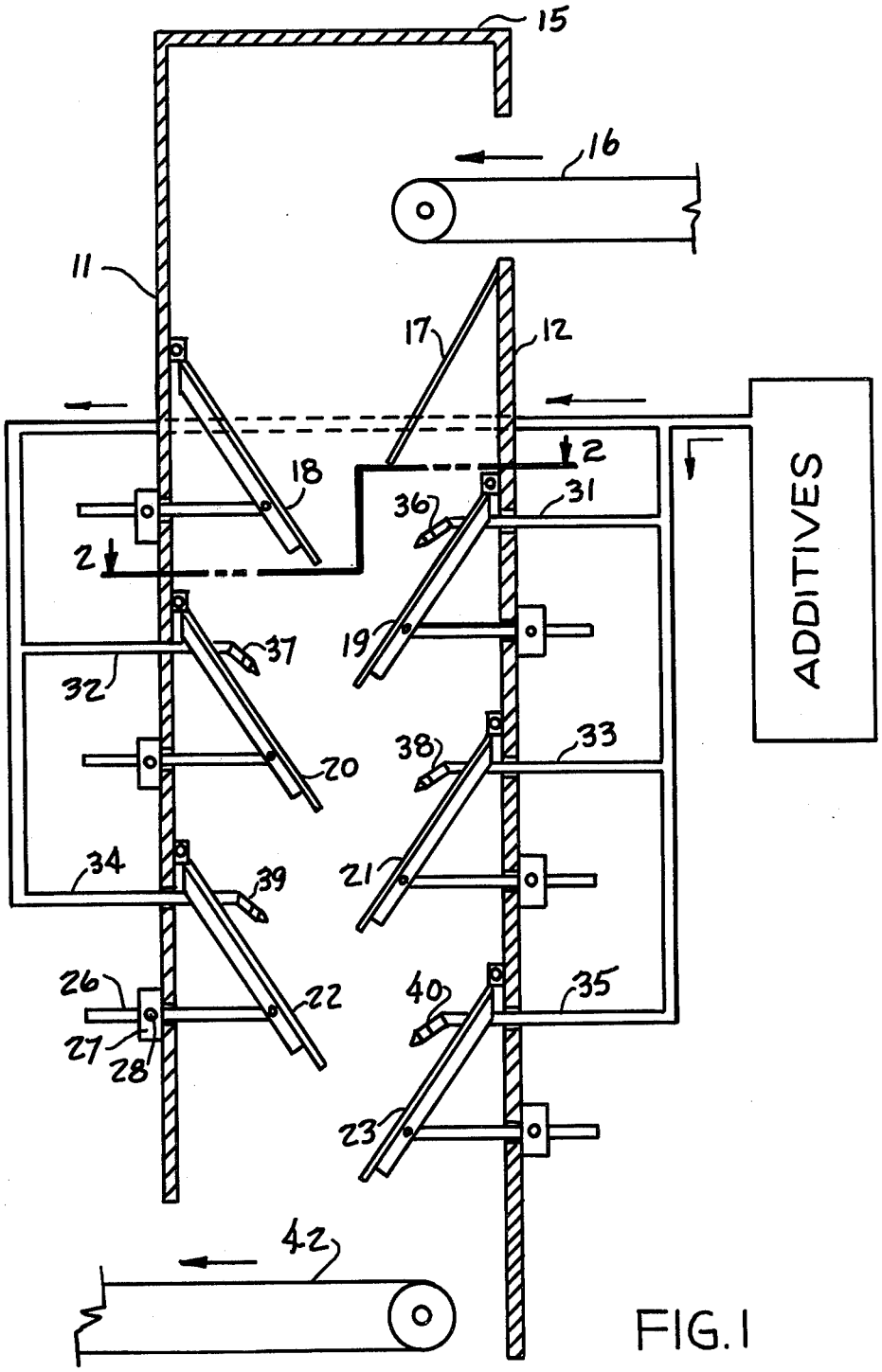
FIG. 1 is a side elevational view of a tobacco treating tower having a rectangular cross section wherein one of the side walls has been removed.
Figure 2:
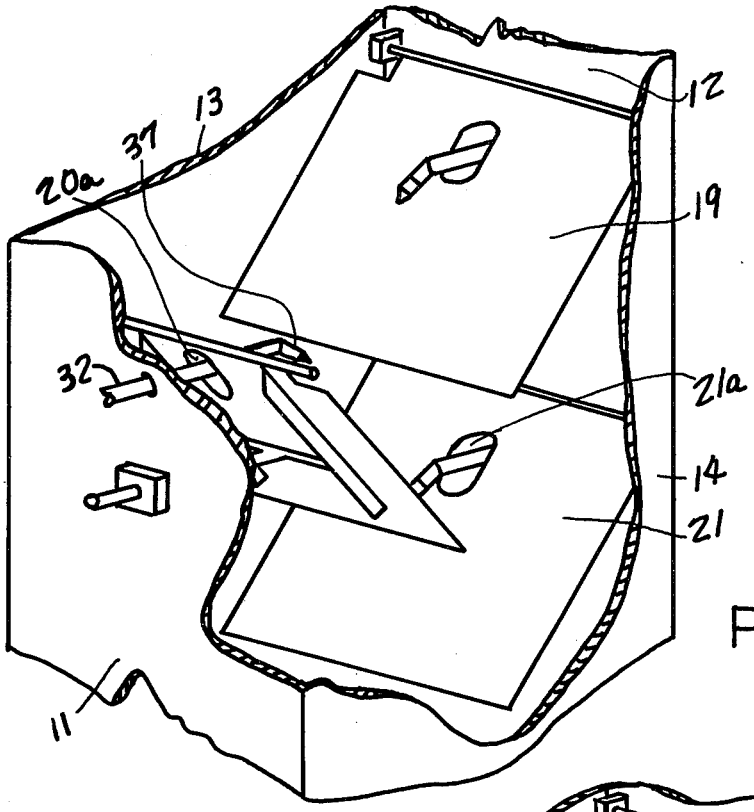
FIG. 2 is a cross section taken along the line 2—2 of FIG. 1 shown in a perspective view and partly broken away to show interior detail.

With particular reference to FIGS. 1 and 2 the apparatus comprises a vertically arranged tower having a rectangular cross section with side walls 11, 12, 13 and 14 and top panel 15. Hingedly secured to side walls 11 and 12 are baffles 18, 19, 20, 21, 22 and 23. Each of the baffles is adjustably positioned by a support rod as shown, for example, by support rod 26 which is secured to baffle 22 and is slidably inserted in adjustment block 27 provided with set screw 28. The angle between each baffle and a vertical plane aligned with the hinged edge of the baffle may vary from about 20 to about 40 degrees although it is preferred that this angle be maintained within the range of approximately 28 to 34 degrees. The particular angle selected will depend to some extent on the distance between opposing side walls 11 and 12 as well as on the size of the baffles. It is important that the various dimensions and angles be such that tobacco introduced into the upper portion of the tower will not be able to fall freely without being deflected by one or more of the baffles in its downward path through the tower.

Each of baffles 19–23 is provided with an opening located near the hinged edge of the baffle through which treating fluid conduits 31, 32, 33, 34 and 35 protrude. Conduits 31–35 terminate in spraying devices 36, 37, 38, 39 and 40, respectively. The openings in the baffles are shown, for example, as 20*a* and 21*a* in FIG. 2. Alternatively, conduits 31–35 can be introduced through the side walls immediately above the hinged sides of the respective baffles to make openings in the baffles unnecessary. In any case each spraying device is positioned so that it does not interfere with the adjustable span of the baffles and is shielded from falling tobacco by a baffle located immediately above the nozzle. Thus, fixed baffle 17 shields spraying device 36 from the tobacco stream entering the tower on conveyor 16 and adjustable baffle 18 has no spraying device associated with it. The spray heads are preferably aimed at the falling tobacco stream so that the treating fluid contacts the tobacco at a point just below each baffle. If desired the tobacco treating fluid conduits may be provided with valves to permit flow to selected spraying devices only. Also, separate treating fluid supply systems may be employed for supplying selected spraying devices so that two or more additive-containing treating fluids may be applied to the tobacco during a single pass through the tower.

The number of baffles and spraying devices required for mixing and treating the falling tobacco before it is removed from the tower by discharge conveyor 42 will be determined by the additive being applied and the results desired. Increasing the number of baffles increases the amount of agitation and mixing of the tobacco caused by the back and forth deflection of the tobacco. Likewise, an increase in the number of spraying devices for applying a given quantity of additive to a specified amount of tobacco will tend to provide a more uniform distribution of additive throughout the mass of tobacco. Generally, it is preferred that the treating tower be provided with at least two spraying devices for applying additives and at least three baffles for deflecting the tobacco stream being treated.

The types of spraying devices selected for use in the presently disclosed apparatus will be based on the particular additive being applied and the properties of the treating fluid containing the additive. It is preferred that the spraying device be provided with means for directing a flat spray pattern having dimensions which approximate the width of the band of tobacco at the point where the treating fluid contacts the tobacco. If the width of the band of tobacco being treated is substantially greater than the width of the spray pattern where it makes contact with the tobacco, two or more spraying devices may be located side by side so that the combined width of the spray patterns approximates the width of the band of tobacco. Commercially available spraying devices are specifically designed for application of low viscosity liquids, high viscosity liquids, suspensions of finely divided solids, etc. When the treating fluid comprises a polyhydric alcohol humectant, a particularly preferred type of spraying device for use with the present invention is a spray nozzle that is provided with gas atomizing means. Such devices are capable of producing a finely atomized spray with spray dimensions that can be varied by changing the gas pressure and/or the treating fluid pressure.

Figure 3:
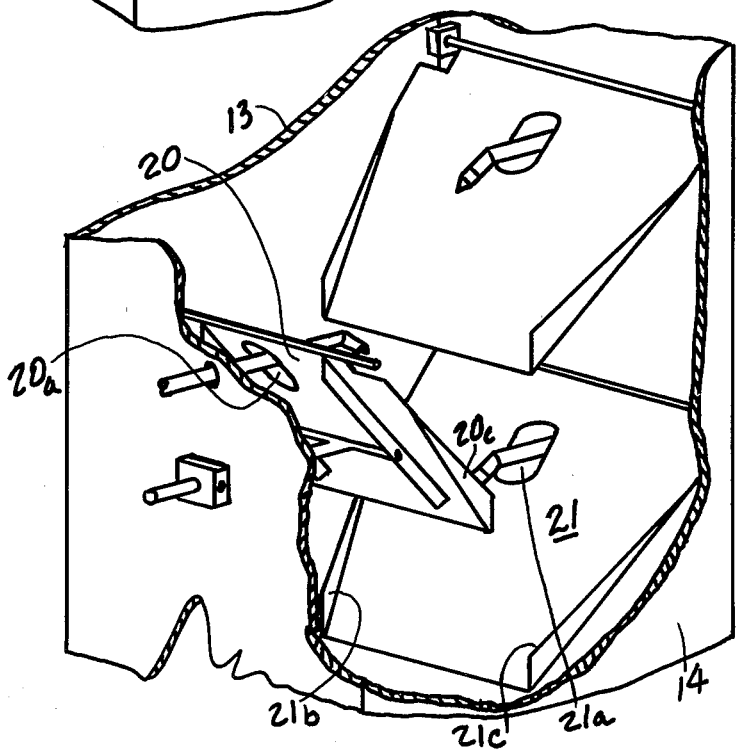
FIG. 3 is similar to the view shown in FIG. 2 but with a slight modification of the shape of the baffles.

FIG. 3 shows a view similar to that of FIG. 2 except that portions 21*b* and 21*c* of the edges of baffle 21 which are adjacent to side walls 13 and 14 are turned upward in scoop-like fashion. This modified form of baffle serves to turn the edges of the band of falling tobacco inwardly thereby providing additional mixing of the tobacco. This modification is desirable to compensate for additive spray patterns which do not quite reach the extreme edges of the band of tobacco. Although the spray pattern could be enlarged to a width slightly exceeding the tobacco band, that would lead to objectionable deposits of treating fluid on side walls 13 and 14 with a gradual buildup of tobacco fines adhered to the treating fluid.

An alternative to the arrangement shown in FIGS. 1 and 2 which avoids the gradual buildup of treating fluid and tobacco fines on walls 13 and 14 of the tower involves a design wherein the width of walls 11 and 12 is increased in that portion of the tower which is adjacent to the zone where the spraying devices are located without corresponding increases in the size of the baffles or the width of the band of tobacco flowing downwardly through the tower. The increase in the width of walls 11 and 12 in the spraying zone of the tower results in walls 13 and 14 being located further from the adjacent edges of baffles 19 through 23 and the edge of the spray pattern associated with the spraying devices.

Figure 4:
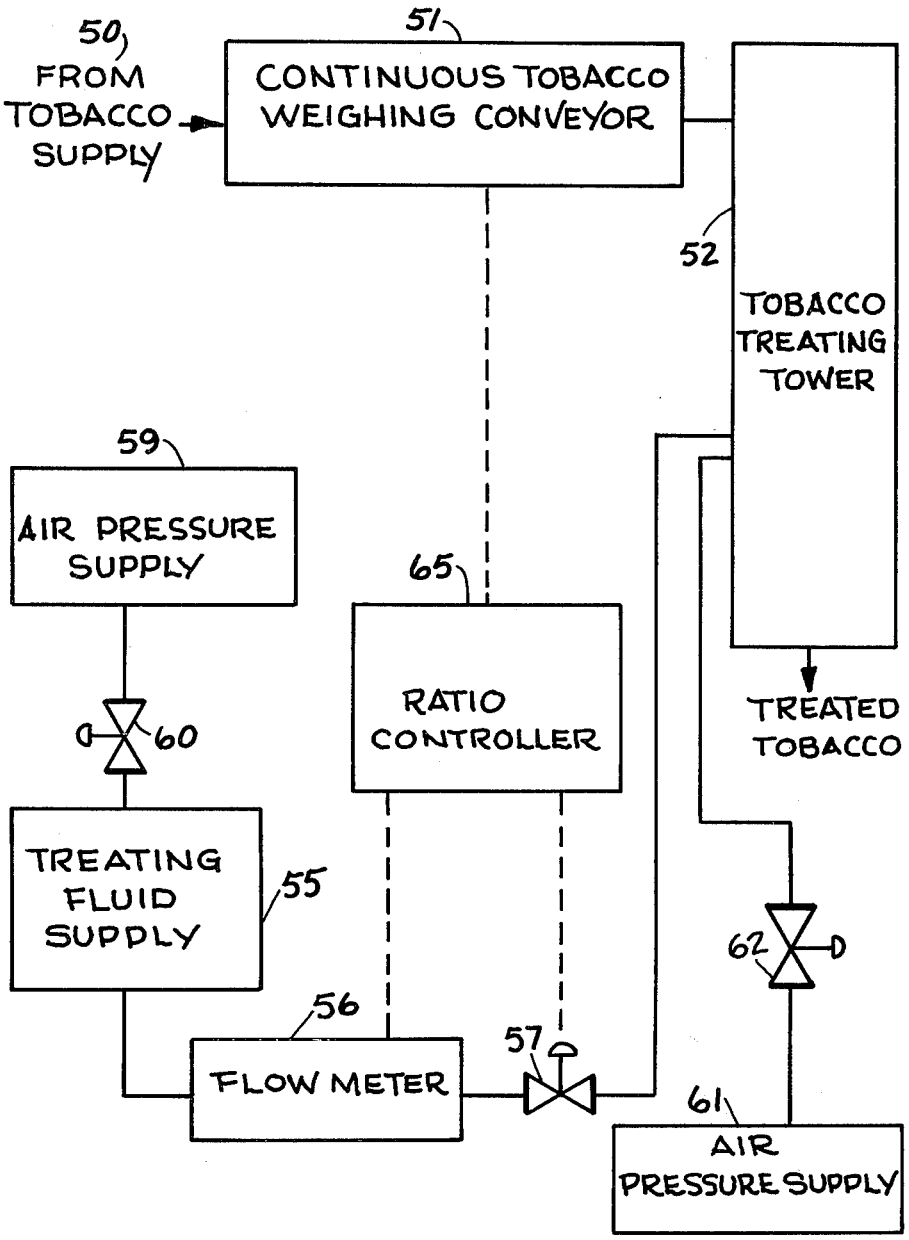
FIG. 4 is a diagrammatic representation of a preferred embodiment for treating tobacco in accordance with the present invention.

An important aspect of the present invention is the manner in which the flow rates of the treating fluid and tobacco streams are controlled as they are introduced into the treating tower to give consistent and precise quantities of each. FIG. 4 shows a diagrammatic view of a process arrangement that has proven to be very satisfactory in this regard. Cut tobacco from tobacco supply 50 is conveyed via continuous tobacco weighing conveyor 51 to the inlet of vertically disposed tobacco treating tower 52 having a construction similar to that shown in FIG. 1. Treating fluid from receptacle 55 is fed by conduit means through flow meter 56 and flow control valve 57 to a plurality of vertically spaced spray nozzles in tower 52. Spray nozzles provided with gas atomizing means are preferably used such as spray set-up Nos. E18A, 1/4J 13 303 or 1/4J 13A 303 available from Spraying Systems Company of Wheaton, Ill. 60187. The design of spray set-up No. E18A comprises a nozzle having a liquid supplied to it under pressure provided by compressed air supply 59 as regulated by pressure control valve 60 and an external mix air cap which utilizes compressed air supplied by compressed air supply 61 via pressure control valve 62 to atomize the liquid as it emerges from the nozzle. Flow meter 56 is preferably based on mass flow measuring principles such as the model No. B-12 device available from Micro Motion Inc. of Boulder, Colo. which is provided with means for transmitting an electrical signal that reflects the treating fluid flow rate at any given instant to ratio controller 65. Weighing conveyor 51 is also provided with means for transmitting to ratio controller 65 an electrical signal reflecting the tobacco flow rate at any given instant to tower 52. Ratio controller 65 is adapted to receive the electrical signals from tobacco weighing conveyor 51 and flow meter 56 and is provided with means for adjusting flow control valve 57 so that a predetermined ratio of treating fluid to tobacco is continuously introduced into the tower through the tower inlet and the spray nozzles.

The following examples will serve to illustrate further the advantages of this invention.

EXAMPLE 1

A tobacco treating tower system similar to that shown in the drawings was used for applying flavoring materials to cut tobacco. The height of the tower was about 244 cm. and its rectangular cross section measured approximately 61 cm. by 46 cm. The tower was provided with nine adjustable baffles each measuring about 48 cm. by 43 cm. and hingedly attached to two opposing side walls of the tower in alternating fashion vertically spaced approximately 23 cm. apart. The baffles were adjusted to slope downwardly toward the central portion of the tower at an angle of about 31 degrees with respect to the side wall of the tower to which the respective baffles were attached. The tower was also provided with seven spray nozzle units vertically spaced in alternating fashion approximately 23 cm. apart. The spray nozzle units were of the external mix air atomizing type (spray set-up No. E18A available from Spraying Systems Company, Wheaton, Ill.) designed to deliver a flat spray pattern. The nozzle units were adjusted so that the plane of the flat spray pattern was directed downwardly about 45° from the vertical. Cut tobacco was delivered to the treating tower at a flow rate of about 6,800 kg./hr. via a Proctor & Schwartz continuous weighing conveyor and a 46-cm. wide conveyor belt with an associated rotating "kicker" positioned above the belt for the purpose of levelling the mass of tobacco to give a tobacco layer of uniform depth. A flavoring solution comprising 63.4 parts by weight propylene glycol and 36.5 parts by weight menthol was delivered to the system of spray nozzle units in the treating tower from a supply tank provided with a head pressure of approximately 4220 g/cm$^2$ (gauge). A model No. B-12 Micro Motion flow transmitter employing a flow meter based on Coriolis/Gyroscopic principles (available from Micro Motion Incorporated of Boulder, Colo.) was used to measure continuously the flow of the flavoring solution with respect to the cut tobacco flow rate. The over-all flow rate of the flavoring solution to the spray nozzle units was approximately 45 kg./hr. Atomization of the flavoring solution was achieved by compressed air supplied to the spray nozzle units at a constant pressure of about 1265 g/cm$^2$ (gauge). The treated tobacco emerging from the tower was collected in containers having a capacity of about 90 kg. and was stored in the containers at ambient temperature and pressure conditions for 24 hours. Three tobacco samples were then taken from each of three containers and the samples were analyzed for menthol. The menthol levels found in each of the nine samples ranged from 0.22 to 0.25 percent by weight with an average value of 0.24 percent.

Cigarettes prepared with the treated tobacco were smoked by a panel of expert smokers in a comparative test with control cigarettes prepared from tobacco which had been treated with an ethanolic solution of menthol in a rotary drum (menthol level in control cigarettes was about 0.27 percent by weight). The test cigarettes were adjudged to have a better menthol flavor than the control cigarettes with two-thirds of the panelists indicating a preference for the test cigarettes.

EXAMPLE 2

A tobacco treating tower system similar to that shown in the drawings was used for applying menthol to shredded tobacco. The height of the tower was about 244 cm. with the upper half of the tower having a rectangular cross section measuring 61 cm. by 46 cm. The lower half of the tower was also rectangular in cross section but measured 61 cm. by 76.5 cm. The tower was provided with seven baffles measuring about 48 cm. by 46 cm. vertically spaced approximately 23 cm. apart and secured to opposing side walls of the tower in alternating fashion so that they sloped downwadly toward the central portion of the tower at an angle of about 31 degrees from the vertical. The lower half of the tower was provided with six air atomizing spray nozzles (spray set-up No. E18A available from Spraying Systems Company of Wheaton, Ill.) arranged in two sets of three nozzles each. The three nozzles in each set were separated from each other approximately 15 cm. in the horizontal direction. With the baffles being assigned numbers 1 through 7 beginning with the uppermost baffle, one set of three spray nozzles was positioned just below baffle 4 so that the orifice ends of the nozzles were approximately 4 cm. away from the falling stream of tobacco. The remaining set of three spray nozzles was similarly positioned just below baffle 5. Shredded tobacco was delivered to the treating tower at a flow rate of 6,800 kg./hr. via a Proctor & Schwartz continuous weighing conveyor and a 46-cm. wide conveyor belt with an associated rotating "kicker" positioned above the belt for the purpose of levelling the mass of tobacco to give a tobacco layer of uniform depth. A flavoring solution comprising 63.4 parts by weight propylene glycol and 36.5 parts by weight menthol was delivered to the six spray nozzles in the treating tower from a supply tank provided with a head pressure of approximately 4220 g/cm$^2$ (gauge). A model No. B-12 Micro Motion flow transmitter obtained from Micro Motion Incorporated of Boulder, Colo. was used to measure continuously the flow of the flavoring solution with respect to the flow rate of the shredded tobacco. The flow rate of the flavoring solution to the spray nozzles was approximately 58.6 kg./hr. with atomization of the flavoring solution being achieved by compressed air supplied to the spray nozzle unit at a constant pressure of about 1265 g/cm$^2$ (gauge). The treated tobacco was collected in containers having a capacity of about 90 kg. and was randomly sampled after storage for 24 hours under ambient temperature and pressure conditions. Menthol analyses for nine samples ranged from 0.24 to 0.32 percent by weight menthol with an average menthol level of 0.28 percent by weight.

Cigarettes prepared with the treated tobacco were smoked by a panel of expert smokers in a comparative test with control cigarettes prepared from tobacco which had been treated with an ethanolic solution of menthol in a rotary drum (menthol level in the control cigarettes was about 0.28 percent by weight). The panel detected no significant difference in the menthol flavor of the test and control cigarettes.

What is claimed is:

1. A process for treating cut or shredded tobacco which comprises introducing a continuous stream of cut or shredded tobacco into inlet means in the upper portion of a substantially vertically disposed power, allowing the tobacco so introduced to fall by gravity from the upper portion of the tower to outlet means in the lower portion of the tower, momentarily deflecting the falling tobacco by means of a plurality of cooperating, vertically spaced baffles extending inwardly from opposing sides of said tower in altenating fashion intermediate the inlet and outlet means and directing a treating fluid onto the falling tobacco from a plurality of spraying devices located within the tower at points intermediate the inlet and outlet means.

2. The process of claim 1 wherein the quantity of treating fluid directed onto the falling tobacco from the plurality of spraying devices is controlled with respect to the quantity of tobacco introduced into the tower.

3. The process of claim 1 wherein the spraying devices comprise spray nozzles provided with gas atomizing means.

4. The process of claim 1 wherein the treating fluid comprises a liquid humectant in combination with one or more flavoring additive materials.

5. The process of claim 4 wherein the treating fluid includes menthol.

6. The process of claim 4 wherein the humectant is a polyhydric alcohol selected from the group consisting of propylene glycol, glycerol, α-methylglycerol, diethylene glycol, dipropylene glycol, trimethylene glycol, triethylene glycol, 1,2-butanediol, 1,3-butanediol, 1,4-butanediol and 2,3-butanediol.

7. Apparatus for treating cut or shredded tobacco comprising a vertically disposed tower having side walls and provided with (a) inlet means in the upper portion of the tower for introducing a stream of cut or shredded tobacco into the tower for non-compacted gravity flow downwardly through the tower, (b) outlet means in the lower portion of the tower for discharging treated tobacco, (c) a plurality of cooperating, vertically spaced baffles extending inwardly from opposing side walls of said tower in alternating fashion intermediate the inlet and outlet means for deflecting momentarily the downward flow of the tobacco and (d) a plurality of spraying devices located within the tower at points intermediate the inlet and outlet means for applying a treating fluid to the cut tobacco as it flows downwardly through the tower.

8. The apparatus of claim 7 wherein the spraying devices comprise spray nozzles provided with gas atomizing means.

9. The apparatus of claim 8 which includes control means for regulating the quantity of treating fluid supplied to the spraying devices with respect to the quantity of tobacco introduced into the tower.

10. The apparatus of claim 7 wherein the vertically spaced baffles are adjustably secured to said side walls so that the baffles slope downwardly toward the central portion of the tower to form an angle between 20 and 40 degrees from the vertical.

11. Apparatus for treating cut or shredded tobacco with a treating fluid containing a flavoring additive which comprises (a) a continuous tobacco weighing conveyor provided with means for transmitting an electrical signal which reflects the tobacco flow rate at any given instant, (b) a receptacle containing a supply of said treating fluid, (c) a vertically disposed tower having side walls and provided with inlet means in the upper portion of the tower through which a stream of cut or shredded tobacco from said continuous tobacco weighing conveyor is introduced into the tower for non-compacted gravity flow downwardly through the tower, (d) outlet means in the lower portion of the tower for discharging treated tobacco, (e) a plurality of cooperating, vertically spaced baffles extending inwardly from opposing side walls of said tower in alternating fashion intermediate the inlet and outlet means for deflecting momentarily the downward flow of the tobacco, (f) a plurality of vertically spaced spraying devices located within the tower at points intermediate the inlet and outlet means for applying the treating fluid to the tobacco as it flows downwardly through the tower.

(g) conduit means connecting said receptacle with said spraying devices through which said treating fluid flows, (h) a flow meter associated with said conduit means provided with means for transmitting an electrical signal which reflects the treating fluid flow rate through said conduit means at any given instant, (i) a flow control valve associated with said conduit means and located between said flow meter and said spraying devices, and (j) a ratio controller adapted to receive the electrical signals from said continuous tobacco weighing conveyor and said flow meter, said ratio controller being provided with means for adjusting the flow control valve so that a pre-determined ratio of treating fluid to tobacco is continuously introduced into the tower through said inlet means and said spraying devices.

12. The apparatus of claim 11 wherein the flow meter is based on mass flow, regenerative sonics, magnetic flow or turbine flow principles.

13. The apparatus of claim 11 wherein the spraying devices comprise spray nozzles provided with gas atomizing means.

14. The apparatus of claim 11 wherein the vertically spaced baffles are adjustably secured to said side walls so that the baffles slope downwardly toward the central portion of the tower to form an angle between 20 and 40 degrees from the vertical.

* * * * *